US010190271B2

(12) United States Patent
Thrall et al.

(10) Patent No.: US 10,190,271 B2
(45) Date of Patent: Jan. 29, 2019

(54) ADJUSTABLE MODULES FOR VARIABLE DEPTH STRUCTURES

(71) Applicants: University of Notre Dame du Lac, Notre Dame, IN (US); HNTB Corporation, New York, NY (US)

(72) Inventors: Ashley P. Thrall, South Bend, IN (US); Yao Wang, Notre Dame, IN (US); Theodore P. Zoli, III, New York, NY (US)

(73) Assignees: University of Notre Dame du Lac, Notre Dame, IN (US); HNTB Corporation, New York, NY (US)

( * ) Notice: Subject to any disclaimer, the term of this patent is extended or adjusted under 35 U.S.C. 154(b) by 45 days.

(21) Appl. No.: 15/292,801

(22) Filed: Oct. 13, 2016

(65) Prior Publication Data

US 2017/0101748 A1 Apr. 13, 2017

Related U.S. Application Data

(60) Provisional application No. 62/286,678, filed on Jan. 25, 2016, provisional application No. 62/240,776, filed on Oct. 13, 2015.

(51) Int. Cl.

| | |
|---|---|
| ***E01D 4/00*** | (2006.01) |
| ***E01D 6/00*** | (2006.01) |
| ***E04C 3/08*** | (2006.01) |
| ***E01D 15/133*** | (2006.01) |
| *E04C 3/04* | (2006.01) |
| *E04C 3/40* | (2006.01) |

(52) U.S. Cl.

CPC ..... *E01D 6/00* (2013.01); *E01D 4/00* (2013.01); *E01D 15/133* (2013.01); *E04C 3/08* (2013.01); *E04C 3/40* (2013.01); *E04C 2003/0491* (2013.01)

(58) Field of Classification Search

CPC ..... E01D 4/00; E01D 6/00; E01D 15/133; E01D 19/00; E04C 2003/0491

USPC ..... 14/2, 2.4, 4, 5, 10, 13, 14, 24; 52/109, 52/639, 641

See application file for complete search history.

(56) References Cited

U.S. PATENT DOCUMENTS 2,334 A * 11/1841 Cottrell ..... E01D 6/00 14/7
118,566 A * 8/1871 Weimer ..... E01D 15/133 14/13
447,422 A * 3/1891 Zenke ..... E01D 15/133 14/14

(Continued)

OTHER PUBLICATIONS

International Search Report received in related PCT application No. PCT/US16/56873, dated Jan. 13, 2017; 9 pages.

*Primary Examiner* — Gary S Hartmann

(74) *Attorney, Agent, or Firm* — Greenberg Traurig, LLP

(57) ABSTRACT

A structural plane is presented for forming a variable depth structure constructed of adjustable modules. Each module is formed of four links connected with revolute joints. The modules are connected at adjacent lateral joints and by upper and lower chords connecting the upper and lower revolute joints of the modules. The ultimate lateral joints of the modules at each end are connected to each end of the structural plane. The adjustable module and other components can form two- and three-hinged arches made of standard rolled steel sections.

14 Claims, 11 Drawing Sheets

(56) References Cited

U.S. PATENT DOCUMENTS

| | | | | | |
|---|---|---|---|---|---|
| 779,370 | A | * | 1/1905 | Miller | E01D 6/00 14/4 |
| 1,163,641 | A | * | 12/1915 | Cummings | E01D 22/00 14/2 |
| 1,962,820 | A | * | 6/1934 | Knight | E01D 22/00 14/10 |
| 2,559,741 | A | * | 7/1951 | Wachsmann | E04B 1/5843 14/14 |
| 3,152,347 | A | | 10/1964 | Williams | |
| 4,089,148 | A | * | 5/1978 | Oehmsen | E04C 3/005 52/639 |
| 4,156,433 | A | | 5/1979 | Beaulieu | |
| 4,179,860 | A | * | 12/1979 | Reale | E04C 3/08 403/384 |
| 4,628,560 | A | | 12/1986 | Clevett et al. | |
| 4,706,436 | A | * | 11/1987 | Mabey | E01D 15/133 14/2 |
| 4,957,186 | A | * | 9/1990 | Reetz | E04C 3/08 248/284.1 |
| 5,024,031 | A | | 6/1991 | Hoberman | |
| 5,724,691 | A | * | 3/1998 | Wiedeck | E01D 15/133 14/14 |
| 6,553,698 | B1 | | 4/2003 | Kemeny | |
| 10,011,961 | B2 | * | 7/2018 | Bouleau | E01D 15/24 |

* cited by examiner

ADJUSTABLE MODULES FOR VARIABLE DEPTH STRUCTURES

CROSS REFERENCE TO RELATED APPLICATION

This application is a non-provisional application claiming priority from U.S. Provisional Application Ser. No. 62/240,776 filed Oct. 13, 2015, entitled "Adjustable Module and Structure" and Ser. No. 62/286,678, filed Jan. 25, 2016, entitled "Adjustable Module for Variable Depth Arch Bridges." Both of which are incorporated herein by reference in their entirety.

GOVERNMENT LICENSE RIGHTS

This invention was made with government support under CMMI-1351272 awarded by the National Science Foundation. The government has certain rights in the invention.

FIELD OF THE DISCLOSURE

The present description relates generally to a new strategy for modular construction using an adjustable module. Example applications can include rapidly erectable bridges, building frames, roofs, and grid shells, among others. This disclosure provides specific detail to an example related to rapidly erectable bridge applications for variable depth arch forms.

BACKGROUND OF RELATED ART

Modular structures, meaning structures comprised of identical repeated components, provide significant construction advantages as components can be prefabricated and mass-produced. Modular design and construction can reduce the overall project cost and project schedule. Modular approaches can be used for a wide variety of structures, including bridges and buildings.

Modular bridges are comprised of prefabricated components or panels that can be rapidly assembled on a site. Existing modular or panelized steel bridging systems (e.g., Bailey, Acrow, Mabey-Johnson) consist of rigid rectangular steel panels that are connected by pins and are arranged in a longitudinal configuration to form a girder-type bridge. They have also been used in alternative configurations to construct bridge piers, suspension bridges, movable bridges, and buildings, as well as for temporary formwork or scaffolding for construction. These modular bridges were developed to serve needs in rapid construction in war, but have also been widely used in emergencies and disasters. Early attempts at modular bridging included the Callender-Hamilton Bridge which was comprised of individual steel members bolted together on site. These were later replaced by the Bailey Bridge system, and its derivatives, which featured rigid panels connected by pins that were easier and faster to erect.

These prior art systems feature rigid, rectangular modules (typically 3.05 m (10 ft) in length, see for example a Bailey panel 10 in FIG. 1A) which are connected longitudinally to form girder-type bridges. Versatility of these existing systems is achieved by stacking modules vertically and/or transversely to reach longer spans (up to 61.0 m to 91.4 m (200 to 300 ft)) and/or higher load capacity (see for example the double-triple configuration—meaning two modules stacked transversely and three modules stacked vertically—of a Bailey system 12 in FIG. 1B). However, the material efficiency (quantified in this disclosure as span squared per weight) of these longer, stacked configurations is limited since (1) material is placed at or near the neutral axis which contributes little to the strength of the system in a bending dominant girder configuration and (2) stacking is not varied along the span despite varying moment and shear demands. This disclosure addresses at least these limitations by developing a new type of module which is capable of varying depth based on demand: an adjustable module which can form variable depth bridges.

Other examples of portable bridges include U.S. Pat. No. 4,628,560 to Merton L. Clevett which describes "transportable bridge structures including pantograph or lazy tong trusses with insertable deck sections to provide parallel tracks or walkways." (Col. 1:12-15) This patent, issued in Dec. 16, 1986, describes "a rapid deployment bridge structure of the foregoing character which is light in weight, easily erected and which floats in water" and "is adjustable in length prior to deployment and erection." (Col 1:33-35, 39-41)

DETAILED DESCRIPTION

The following description of example methods and apparatus is not intended to limit the scope of the description to the precise form or forms detailed herein. Instead the following description is intended to be illustrative so that others may follow its teachings.

Figure 1A:
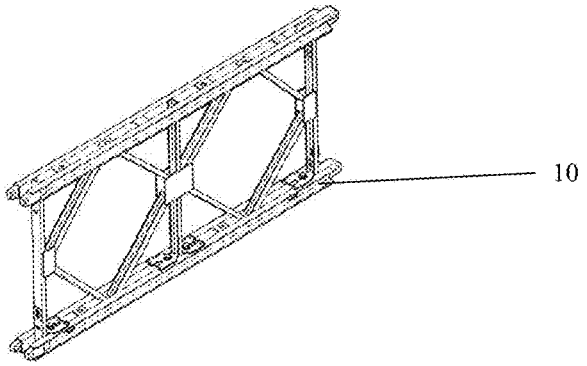
[Prior Art] FIG. 1A
FIG. 1A is a prior art Bailey Bridge panel.
Figure 1B:
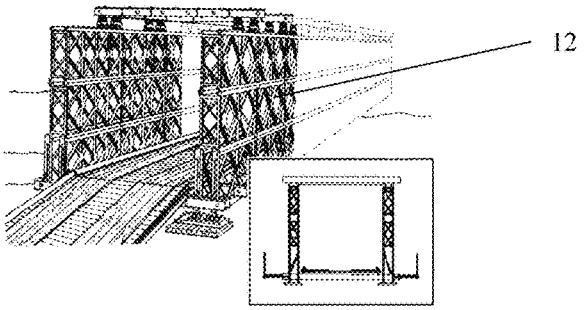
[Prior Art] FIG. 1B
FIG. 1B is a prior art double-triple girder-type configuration of Bailey Bridge panels of FIG. 1A forming a bridge.
Figure 2:
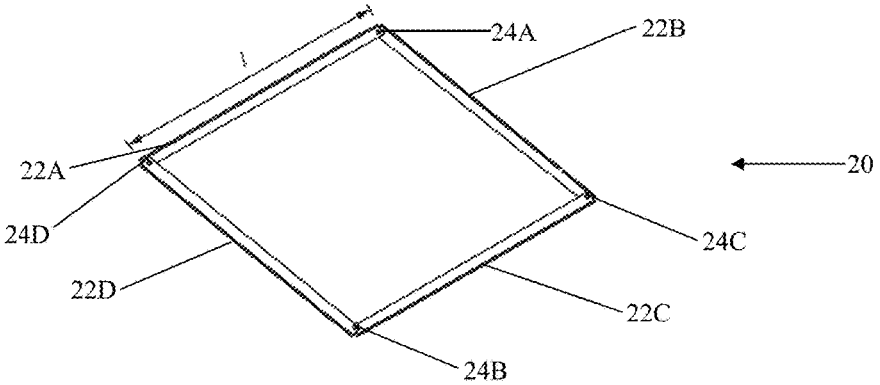
FIG. 2 is an elevation of an example adjustable module of the present disclosure, including one optimized link length (l) determined through the exhaustive parametric study and the section sizes selected through design and analysis in accordance with the teachings of the present disclosure.

Turning to FIG. 2, an example adjustable module 20 is shown. In this example, the adjustable module 20 is constructed of four links 22—comprising a first link 22A, a second link 22B, a third link 22C, and a fourth link 22D. As illustrated, each of the links 22 are connected via a revolute joint 24. More specifically, an upper revolute joint 24A connects the first link 22A and the second link 22B, a lower revolute joint 24B connects the third link 22C and the fourth link 22D, a first lateral revolute joint 24C connects the second link 22B and the third link 22C, and a second lateral revolute joint 24D connects the first link 22A and the fourth link 22D. FIG. 2 shows the adjustable module 20 with all four links 22 having the same length (l). However, each link could be of a different length. It is appreciated that the revolute joint 24 connecting the module links is a bolt which is tightened on site in the disclosed example.

Figure 6A:
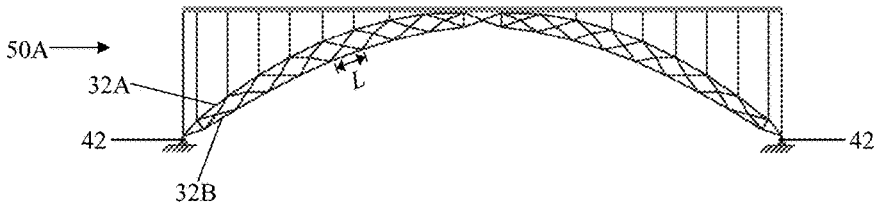
FIG. 6A is a front elevation of an example three-hinged arch forming a bridge.
Figure 6B:
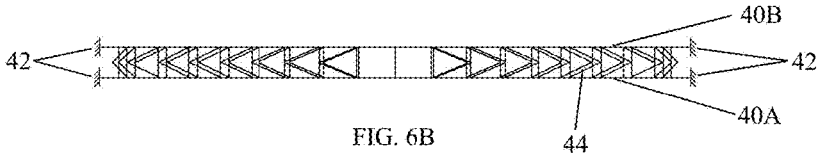
FIG. 6B is a top plan view, without the deck, of the example three-hinged arch of FIG. 6A.
Figure 6C:
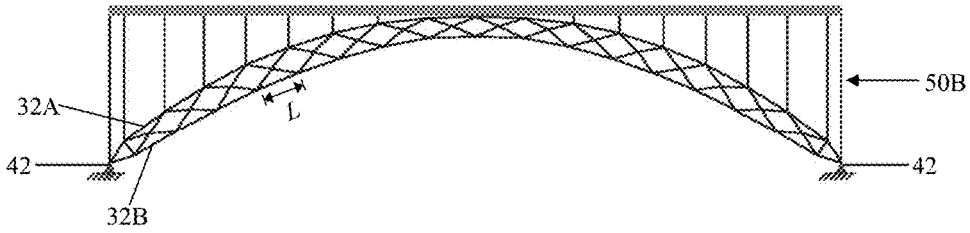
FIG. 6C is a front elevation view of an example two-hinged arch forming a bridge.

Having constructed the example adjustable module 20, the efficacy of the adjustable module 20 (shown in FIG. 2) that can form variable depth bridges 50 (see the example shown in FIGS. 6A and C) as a strategy for modular construction can be further analyzed. The module 20 forms part of a variable depth structure by preventing the relative rotation of the first link 22A, the second link 22B, the third link 22C, and the fourth link 22D. A variable depth form comprised of the adjustable module 20 is shown for the specific case of three- and two-hinge variable depth arch bridges, but other types of structures (e.g., grid shell, building frame, roof structure) or other forms of bridges are possible. For this study, all links 22 are assumed to be the same length (l), but each link could be of a different length. The relative rotation of the links 22 is prevented by the attachment of the upper and lower chords 32A, 32B to form the variable depth arch bridges in this example. The specific examples analyzed include: (1) presenting methodologies for the development of rational variable depth forms, (2) evaluating the geometry of the adjustable module 20 to scribe these rational forms, and (3) demonstrating the promise of the adjustable module 20 to form variable depth arch bridges through three-dimensional finite element analyses. The present disclosure first presents methodologies for determining rational variable depth forms for the example three- and two-hinged arches based on behavior under gravity loads. Then a scribing procedure, in which the adjustable module 20 is shown to be able to generate these variable depth forms, is disclosed. With this scribing procedure, an exhaustive parametric study is performed to determine a module link length (l) which features versatility in form (meaning that it is capable of scribing a large span range for both three- and two-hinged arches) and minimizes susceptibility to chord segment buckling (quantified as the longest unbraced length (L) of an upper or lower chord 32 as shown in FIGS. 6A and 6C squared to relate to Euler buckling). The promise of the adjustable module 20 is then demonstrated through finite element analyses for a 91.4 m (300 ft) span bridge. The material efficiency of the adjustable module 20 for variable depth arch bridges is compared to an existing panelized system to demonstrate one of the advantages of this system compared to existing technology. This application ultimately discloses an example panelized bridging component with enhanced material efficiency and versatility of form.

The adjustable module of the present disclosure is capable of scribing a wide variety of variable depth forms, which can be arrived at using a variety of methodologies as would be appreciated by one of ordinary skill in the art. The focus, however, is on three- and two-hinged arches as arches utilize the cross-section more effectively than the flexural behavior of the girder-type configuration of existing panelized bridging systems. Furthermore, the adjustable module 20 (FIG. 2) forms a naturally articulated pin for hinges in the example three- and two-hinged arch forms for bridge plane 40. Two methodologies for the development of rational variable depth arch forms are used herein. It will be appreciated by one of ordinary skill in the art, however, that other suitable arches or other variable depth forms may be utilized as desired. The depth of the form can be varied based on demand by adjusting the module 20.

The example three- and two-hinged arch bridges with flexible, lightweight decks disclosed herein are the arch forms for which the variable depth module 20 provide many advantages. A flexible, lightweight deck is attractive for rapid erection of modular systems and offers advantages in transportability. This type of deck, however, leads to high bending in the arch under asymmetric live loading, particularly at the quarterpoint, requiring greater structural depth in these regions. At the hinges, effectively no structural depth is required, and the forms can narrow to the naturally articulated pins. Similarly, the arch forms or other variable depth forms could be used for other structure types, such as a grid shell, building frame, roof structure, etc.

In the following sections, methodologies for developing rational variable depth three- and two-hinged arches are disclosed. Example forms are calculated for a 91.4 m (300 ft) span bridge. The self-weight of the arch is assumed to be 5.25 kN/m (360 lb/ft). A lightweight deck is assumed to have a self-weight of 13.1 kN/m (900 lb/ft). The live load is taken as the distributed lane load prescribed by American Association of State and Highway Transportation Officials (AASHTO, hereafter) Load and Resistance Factor Design Specification (9.34 kN/m (640 lb/ft)). Load combinations include the self-weight (of both the arch and deck) with the live load acting over the entire span, over half the span on each side, over ⅝ of the span on each side, and over ⅜ of the center of the span to consider worst effect. It is assumed that two planes of arches will carry these loads, so the magnitude of each is divided in half.

Three-Hinged Arch

An example three-hinged arch form as disclosed herein is desirable as the hinge at the crown enables the arch to adjust for thermal contraction/expansion and for settlement of the supports without imparting internal forces in the arch. In this example, this is particularly appealing for rapidly erected bridges for which foundation conditions may be unknown or undesirable.

Figure 3A:
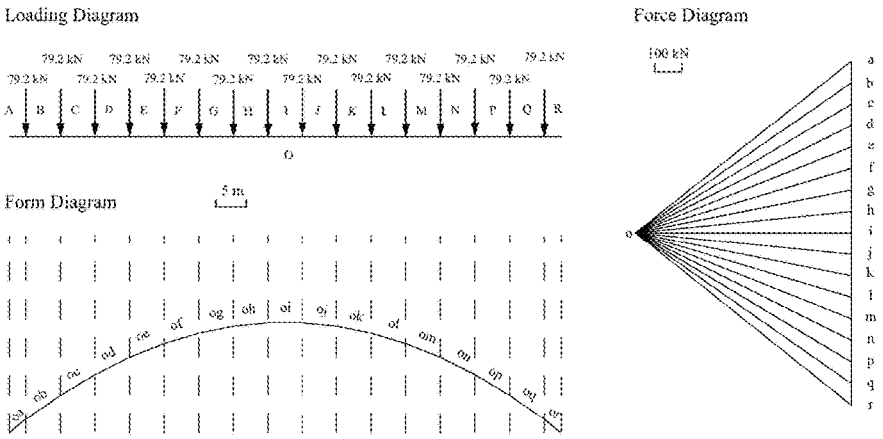
FIG. 3A is a graphic statics calculation for a 91.4 m (300 ft) three-hinged arch with a span-to-rise ratio of 5 subject to a dead load and live load over full span.
Figure 3B:
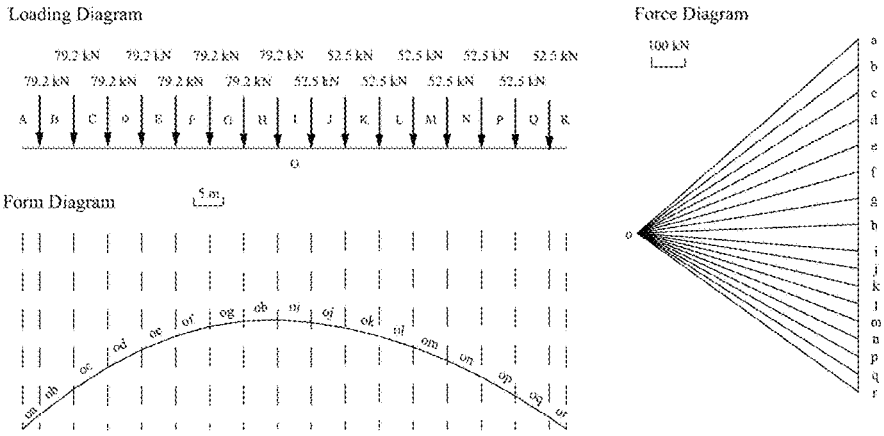
FIG. 3B is a graphic statics calculation for a 91.4 m (300 ft) three-hinged arch with a span-to-rise ratio of 5 subject to a dead load and live load over left half of span.

A rational form for a variable depth three-hinged arch can be developed using graphic statics. Graphic statics is a graphical analysis and design tool for truss-type (i.e., axial load bearing only) structures. While this method has been used for centuries, it is only recently gaining greater attention in the structural engineering research community. This method requires only drafting tools (computerized drafting software packages, e.g., AutoCAD, are often used today for increased accuracy and convenience). Given a loading—in this case distributed loads discussed above which are approximated as point loads in the loading diagram in FIGS. 3A and B for an example 91.4 m (300 ft) span—a "form diagram" can be developed which represents the positioning of structural members for which only axial load (i.e., compression for the arches discussed here) is carried. A reciprocal "force diagram" represents the magnitude of the force in each member under that loading. Rays of the force diagram are parallel to the structural members in the form diagram. The upper-case letters on the loading diagram label intervals between externally applied loads. These correspond to points in the force diagram, identified there by the same, but lower-case letters. Structural members in the form diagram are labeled by the two lower-case letters of the corresponding force ray. To generate the shape of the three-hinged arch under a uniformly distributed load of this disclosure (FIG. 3A, for self-weight and live load over the full span), the load line (vertical line (a)-(r)) in the force diagram is first drawn. The length of line between each lowercase letter corresponds to the scaled magnitude of load applied in the interval between the corresponding upper-case letters in the loading diagram. Under a uniformly distributed load on a symmetric structure, the middle segment (oi) of the form diagram is horizontal. As the form and force diagrams are reciprocal, the corresponding force ray (oi) must also be horizontal. On the force diagram, the point (o) corresponds to the "pole" at which all rays must meet for this system. While the length of ray (oi) is not yet known, point (o) must fall somewhere along this horizontal ray. As the ideal (i.e., no bending) shape of an arch under a uniformly distributed load is a parabola, the angle of the last segments of the form diagram (oa) and (oq) can be determined based on the geometry of a parabola given a desired span and span-to-rise ratio. Corresponding parallel rays can be drawn on the force diagram, thereby locating pole (o). The remaining rays on the force diagram can then be drawn, connecting each remaining lowercase letter (b)-(q) to the pole (o). Finally, the form diagram can be completed by drawing line segments parallel to those in the force diagram. A similar process can be carried out for all loading scenarios discussed above, to develop form diagrams, also known as "pressure lines," for each load (see for example FIG. 3B for dead load and live load over left half the span). For these other loadings, the end segment angles in the form diagram are no longer required to relate to a parabolic shape. Instead, it is required that each form diagram cross through the hinge at the crown of the form diagram for the uniformly distributed load (i.e., dead load and live load over the full span, FIG. 3A).

Figure 4:
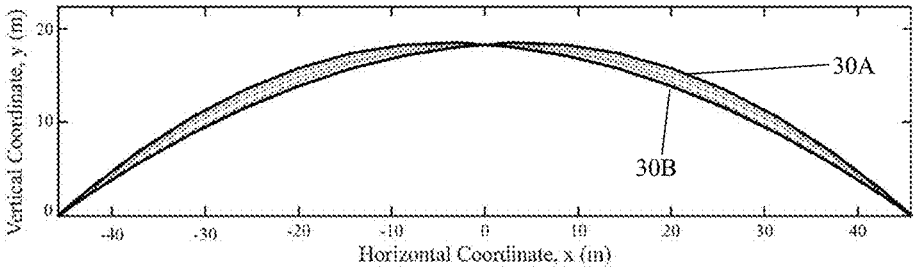
FIG. 4 is a graph showing the graphic statics pressure lines for a 91.4 m (300 ft) three-hinged arch with a span-to-rise ratio of 5 where the envelope is shown in black and individual pressure lines for different load combinations are shown in gray.

In this disclosure, graphic statics was used to develop the pressure lines under all of the different loading scenarios discussed above (gray lines in FIG. 4). These lines were calculated at discrete points (in this case 19 discrete points) as the distributed loads must be discretized to perform the graphic statics procedure. A black line in FIG. 4 indicates an envelope 30A, 30B of these lines. The envelope of pressure lines 30A, 30B provides the form for a three-hinged arch such that the arch is always in compression. In this example, the geometry of the upper chord 32A and lower chord 32B shown in FIG. 6A is determined by following the geometry of the envelope of the pressure lines 30A, 30B. The aim is to eliminate stress reversals in the chords 32A, 32B and the resulting susceptibility to fatigue and fracture. Furthermore, connection design between chords is simplified if the upper and lower chords 32A, 32B are only subjected to compression and these connections would likewise not be susceptible to fatigue and fracture.

Figure 5:
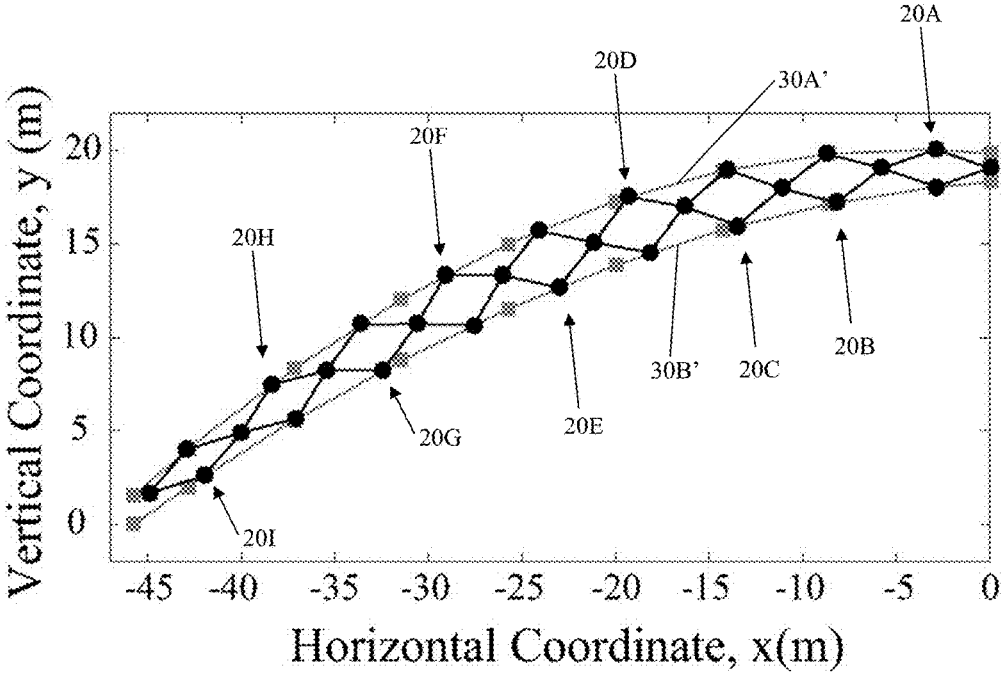
FIG. 5 is a form development graph for a variable depth three-hinged arch, shown for 91.4 m (300 ft) span, span-to-rise ratio of 5. The gray square markers indicate the discrete points at which the envelope of pressure lines was calculated (with additional 1.52 m (5 ft) of depth added for feasibility), the gray lines are polynomial curves fit to these discrete points, the black lines indicate the links of the adjustable module, and the black circles indicate the revolute joints of the adjustable module.

The development of the geometry of the chords 32A, 32B from the pressure line envelopes 30A, 30B is shown in FIG. 5. In any kind of modular or panelized system, a minimum depth is required. To account for this, an additional 1.52 m (5 ft) of depth is added to the discrete points of the upper pressure line envelope 30A, developing the coordinates of the upper gray squares shown in FIG. 5. The lower pressure line envelope 30B directly defines the coordinates of the lower gray squares shown in FIG. 5. Polynomial curves 30A' and 30B' are fit to the coordinates of the discrete points to generate continuous functions (gray lines) between which the adjustable module 20 can be scribed as shown in FIG. 5. Modules 20A, 20B, 20C, 20D, 20E, 20F, 20G, 20H, and 20I (black circles represent the revolute joints 24, black lines represent the links 22) are scribed within these curves 30A', 30B' for an example 91.4 m (300 ft) span with a span-to-rise ratio of 5 in FIG. 5. The upper and lower chord 32A, 32B shown in FIG. 6A is then generated by connecting straight line segments between the module revolute joints 24. FIGS. 6A and 6B shows the elevation and plan view of the final form for the example three-hinged arch bridge planes 40 constituting the example three-hinged arch bridge 50A. As shown, a first bridge plane 40A and a second bridge plane 40B are connected by lateral braces 44 and restrained by hinges 42 (meaning boundary conditions that restrain translation in all directions, and permit rotation only about the axis perpendicular to the plane of the arch).

Two-Hinged Arch

Alternatively, in some instances, a two-hinged arch can be desirable over a three-hinged arch as the hinge at the crown can be avoided, thereby leading to savings in fabrication cost. Furthermore, the redundancy of the two-hinged arch enables the system to maintain stability even if a part of upper or lower chords 32A, 32B is damaged as it is capable of redistributing moment. Since the two-hinged arch form is statically indeterminate, an alternative approach to developing its form based on moment demand under asymmetric live load and in-plane buckling of the arch is used.

Figure 7:
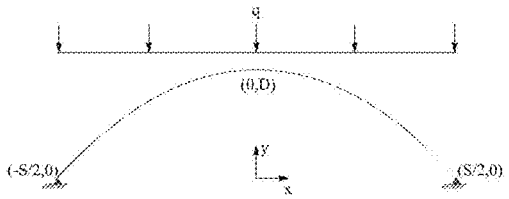
FIG. 7 is the geometric coordinates and loading used in one example of the modeling and design of a modular bridge in accordance with the teachings of the present disclosure.

The bending moment under asymmetric live loads of this statically indeterminate structure can be determined by first finding the horizontal reaction using the method of virtual work. In the method of virtual work, the horizontal degree of freedom at one of the arch hinges is hypothetically released, thereby enabling horizontal translation of the arch under load. This horizontal translation due to load is determined mathematically. Likewise, the horizontal translation due to only a horizontal thrust is determined. These are set equal to one another and the horizontal thrust (i.e., reaction) is therefore found. More specifically in this disclosure, the centerline of the arch, with a span (S) and rise (D), is chosen to be a parabola given by the following equation:

$$y = -\frac{4D}{S^2}x^2 + D \qquad \text{(Eq. 1)}$$

as this is the ideal form for an arch carrying only compression under a uniformly distributed load (see FIG. 7 for the assumed coordinate system, in which (x) is the horizontal coordinate and (y) is the vertical coordinate). Assuming that shear and axial deflections are negligible, the horizontal reaction (H) is then:

$$H = \frac{\int_0 \frac{SM_0 y ds}{EI}}{\int_0 \frac{Sy^2 ds}{EI}} \qquad \text{(Eq. 2)}$$

where ($M_0$) is the bending moment (if the horizontal reaction is released), (s) is the length along the arch centerline, (E) is the modulus of elasticity, and (I) is the moment of inertia. These integrals can be approximated as summations over curved segments of the arch (in this case, 16 curved segments were considered along the full span). With the horizontal reaction determined, the axial force, shear, and bending moment can then be calculated using static equilibrium conditions along the full length of the arch.

Further, deflections induced by asymmetric live loads in combination with axial forces from self-weight and the live load cause increased deflection and moment in the arch. The increased deflection and moment can be accounted for in design by moment magnification factors ($A_{FS}$) as follows:

$$A_{FS} = \frac{1}{1 - \frac{P_4}{a_4 F_E}} \qquad \text{(Eq. 3)}$$

where (P) is the axial force in the arch at the quarterpoint (denoted as subscript 4), ($a_4$) is the cross-sectional area, and ($F_E$) is the Euler buckling stress which can be calculated by:

$$F_E = \frac{\pi^2 E}{\left(\frac{kZ}{r_4}\right)^2} \qquad \text{(Eq. 4)}$$

where (Z) is half of the length of the arch, (r) is the radius of gyration, and (k) is an effective length factor based on the arch restraint (for 2-hinged arches with a span-to-rise ratio of 5, this is 1.10). Furthermore, arches are susceptible to in-plane buckling, also related to the Euler buckling stress $F_E$. Therefore, the strategy for a rational variable depth two-hinged arch form is determined based on the Euler buckling stress and the moment demand under live load.

Figure 8:
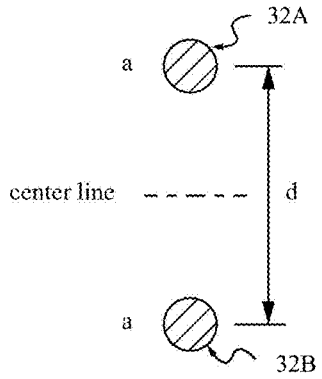
FIG. 8 is a cross sectional view of one bridge plane of the example arch showing both the upper chord and lower chord.

In this disclosure, the depth of the arch is related to the Euler buckling stress and the moment demand as follows. The cross-section of the arch is defined as shown in FIG. 8, where (a) refers to the cross-sectional area of the upper chord 32A and the lower chord 32B and (d) is the distance between the chords 32A and 32B. It is assumed that the cross-sectional area of the chords 32A, 32B remain constant over the arch, but the depth (d) varies. The moment of inertia of the arch is approximated as $I=ad^2/2$ (i.e., the moment of inertia of each chord 32A or 32B about its own centroid is negligible, any contribution from the adjustable module 20 is negligible), with a radius of gyration r=d/2. The flexural stress (a) at the center of each chord 32A or 32B due to a moment (M) is:

$$\sigma = \frac{M}{ad} \qquad \text{(Eq. 5)}$$

The smallest cross-sectional area of the segment of chord 32A or 32B that would result in yielding of the section by flexure is therefore:

$$a = \frac{M}{\frac{F_y}{\Omega} d} \qquad \text{(Eq. 6)}$$

where (M) is the largest magnitude of moment under all load combinations, ($F_y$) is the yield strength (the chords 32A, 32B, in this example, are assumed to be A992 steel with a yield strength of $F_y$=345 MPa (50 ksi)), and (1) is a safety factor (taken to be 1.67 as this is the safety factor for compression elements in Allowable Stress Design). Requiring that the axial stress (from the axial force and the cross-sectional area) be less than the Euler buckling stress at the quarterpoint, the following relationship is determined:

$$\frac{\frac{P_4}{M}}{\frac{F_y}{\Omega} d_4} \leq \frac{\pi^2 d_4^2 E}{4(kZ)^2} \qquad \text{(Eq. 7)}$$

and therefore the depth $d_4$ at the quarterpoint is:

$$d_4 \geq \frac{4P_4 \frac{F_y}{\Omega}(kZ)^2}{M\pi^2 E} \quad \text{(Eq. 8)}$$

The minimum cross-sectional area is then determined using Eq. (6) with this depth at the quarterpoint and the corresponding moment (maximum magnitude over all load combination) at the quarterpoint. The depth throughout the arch is then found by:

$$d \geq \frac{M}{a\frac{F_y}{\Omega}} \quad \text{(Eq. 9)}$$

where (M) is the moment (maximum magnitude over all load combination) along the arch at which (d) is calculated.

Figure 6D:
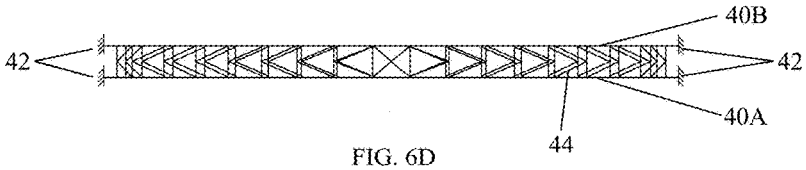
FIG. 6D is a top plan view, without the deck, of the example two-hinged arch of FIG. 6C.
Figure 9:
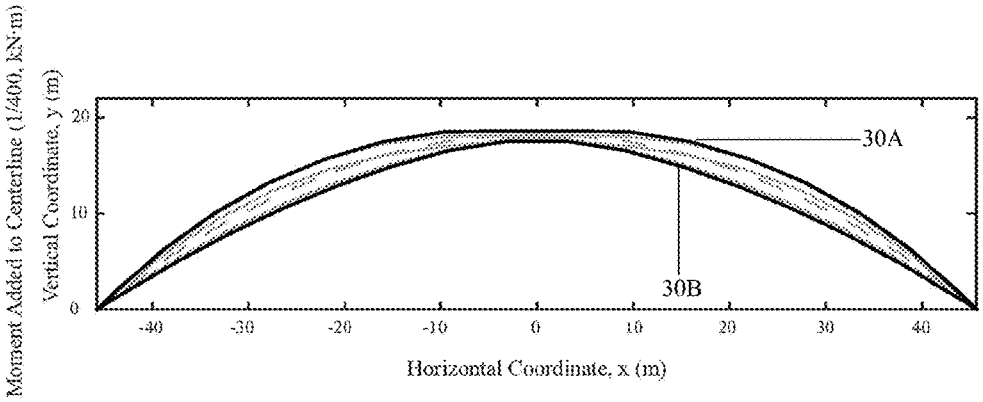
FIG. 9 is a graph showing the moment envelope for a 91.4 m (300 ft) two-hinged arch overlayed over the arch centerline (dashed line).
Figure 10:
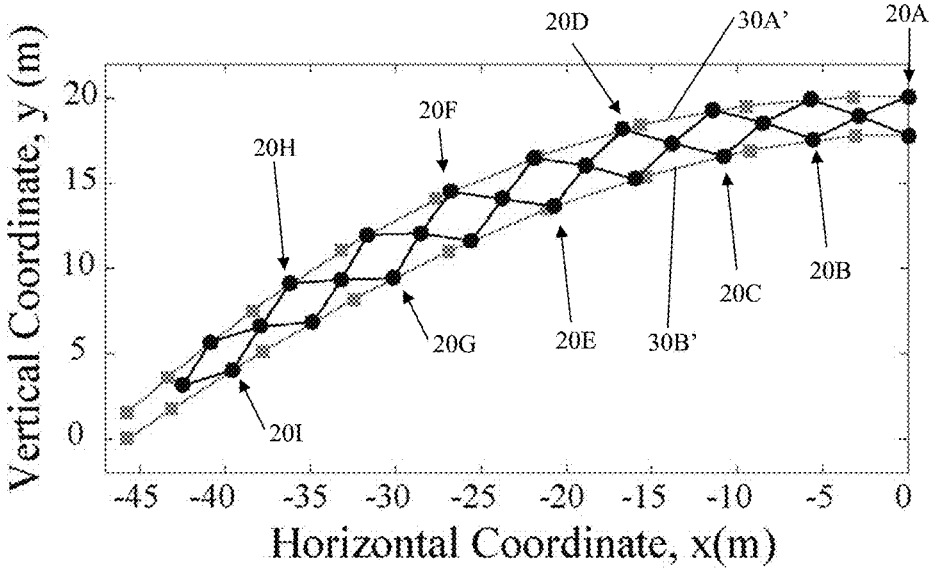
FIG. 10 is a form development graph for a variable depth two-hinged arch, shown for 91.4 m (300 ft) span, span-to-rise ratio of 5. The gray square markers indicate the discrete points at which the moment envelope was calculated (with additional 1.52 m (5 ft) of depth added for feasibility), the gray lines are polynomial curves fit to these discrete points, the black lines indicate the links of the adjustable module, and the black circles indicate the revolute joints of the adjustable module.

FIG. 9 shows the moment for all load combinations (in gray) and the envelope 30A, 30B of these values (in black) for an example 91.4 m (300 ft) span with a span-to-rise ratio of 5. The depth is calculated at discrete points (in this case 19 discrete points) along the arch. The geometry of the chords 32A, 32B of the two-hinged arch are then determined based on this envelope 30A, 30B as shown in FIG. 10. An additional 1.52 m (5 ft) of depth is added to all points for feasibility as discussed for the three-hinged arch and as shown as gray squares in FIG. 10. Polynomial curves 30A', 30B' are fit to the resulting data points to arrive at continuous curves between which the module 20 can be scribed. Modules 20A, 20B, 20C, 20D, 20E, 20F, 20G, 20H, and 20I (black circles represent the revolute joints 24, black lines represent the links 22) are scribed within these curves 30A', 30B' for an example 91.4 m (300 ft) span with a span-to-rise ratio of 5 in FIG. 10. FIGS. 6C-D shows the elevation and plan view of the final form for the example two-hinged arch bridge planes 40 constituting the example two-hinged bridge 50B. As shown, a first bridge plane 40A and a second bridge plane 40B are connected by lateral braces 44 and restrained by hinges 42 (meaning boundary conditions that restrain translation in all directions, and permit rotation only about the axis perpendicular to the plane of the arch).

Evaluation of Geometry of Adjustable Module

The prior sections developed the rational forms for three- and two-hinged arches (given the span S and the span-to-rise ratio) based on governing load demands. This form development culminates in upper and lower continuous curves 30A', 30B' that serve as bounds for variable depth arches. This disclosure shows that these variable depth arches can be formed through the modules 20 comprised of the link 22 with a link length (l) forming a four-bar mechanism (FIG. 2).

Given the topology of the adjustable module 20 shown in FIG. 2, this section evaluates the ability of this geometry to scribe the rational, variable depth forms discussed in the previous section. First, this section presents the geometric process by which these modules 20 scribe variable depth forms. Then a parametric study is performed to determine an optimized link length (l).

Geometric Process for Scribing Adjustable Module

The modules 20 are scribed between the upper and lower continuous curves 30A', 30B' of the rational forms by determining the intersection of circles 26A-26E with radius of the link length (l) and these continuous curves for the example arch forms shown in FIGS. 11A-H. More specifically, the top corner 24A of the module 20 intersects with the upper curve 30A' of the rational form and the bottom corner 24B with the bottom curve 30B'. The other corners 24C connect the modules 20 to one another (FIGS. 2 and 11A-H). The upper chord 32A is then formed by connecting the points 24A to one another by straight line segments, and the lower chord 32B is likewise formed by connecting the points 24B (black dotted lines in FIGS. 11A-H). For the scribing procedure, a desired span must initially be specified. However, it is unlikely that the module 20 would end exactly at the desired span. Furthermore, it is advantageous to end the scribing procedure at a corner 24C as this forms an articulated pin for the hinged arches. Therefore, a scribing termination criteria that a point 24C be within (2l) of the desired span end has been implemented for the scribing procedure. As a result the actual span will be slightly less than the desired span. It is also required that there be at least a 5° angle between the links 22 for feasibility.

Three-Hinged Arch

To achieve a hinge at the crown of the three-hinged arch (FIG. 11A), the modules 20 begin at a point 24C at the crown with a horizontal coordinate $C_x$=0 and a vertical coordinate ($C_y$) which is the average value of the vertical coordinates of the upper and lower curves 30A', 30B' when (x)=0. The vertical coordinates of points 24A and 24B are then found by the intersection of the upper and lower curves, respectively with circle 26A—centered at point 24C (with a radius of link length (l)—which has the following equation:

$$\text{Circle } 26A\text{: } x^2+(y-C_y)^2=l^2 \quad \text{(Eq. 10)}$$

Figure 11A:
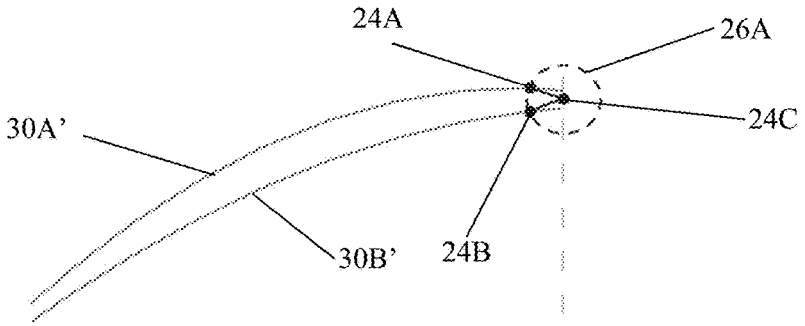
FIG. 11A is the first step in an example scribing procedure for a three-hinged arch.

(FIG. 11A). The next point 24C' is found by the intersection of circle 26B with radius (l) centered at point 24A with the equation:

$$\text{Circle } 26B\text{: } (x-A_{24x})^2+(y-A_{24y})^2=l^2 \quad \text{(Eq. 11)}$$

and circle 26C with radius (l) centered at point 24B with the equation:

$$\text{Circle } 26C\text{: } (x-B_{24x})^2+(y-B_{24y})^2=l^2 \quad \text{(Eq. 12)}$$

Figure 11B:
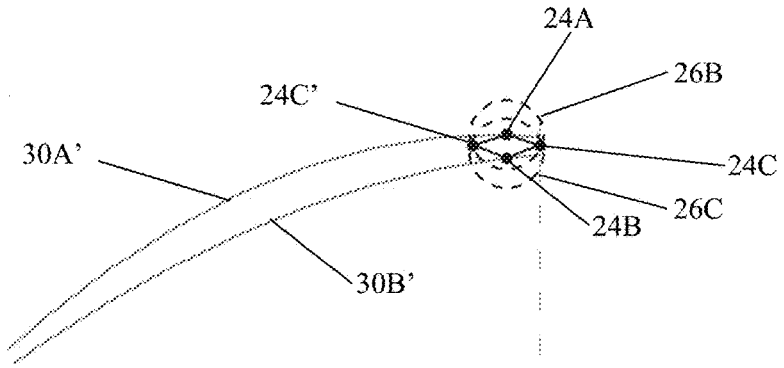
FIG. 11B is the second step in an example scribing procedure for a three-hinged arch.
Figure 11C:
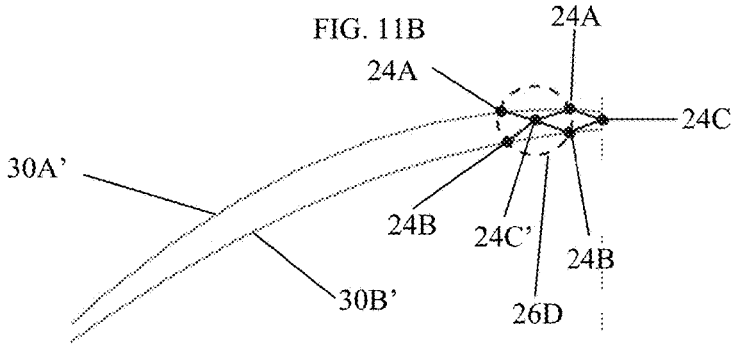
FIG. 11C is the third step in an example scribing procedure for a three-hinged arch.
Figure 11D:
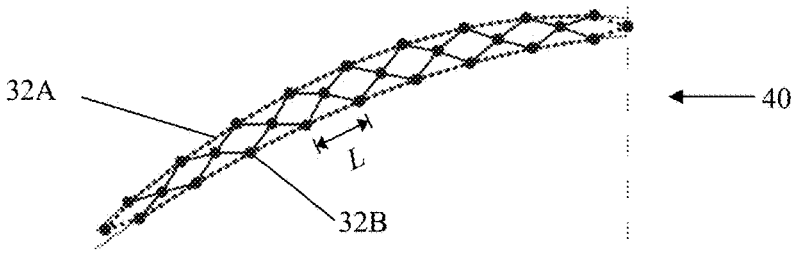
FIG. 11D is an example fully scribed three-hinged arch.

(FIG. 11B). The following points 24A and 24B are found by the intersection of circle 26D with radius (l) centered at 24C' with the equation:

$$\text{Circle } 26D\text{: } (x-C'_{24x})^2+(y-C'_{24y})^2=l^2 \quad \text{(Eq. 13)}$$

and the upper and lower curves 30A', 30B', respectively (FIG. 11C). This continues until the termination at the springing when a point 24C is within (2l) of the desired span (FIG. 11D). The upper and lower chords 32A, 32B are ultimately formed by connecting the 24A points to one another by straight line segments and by connecting the 24B points (black dotted lines in FIG. 11D). Note that at the crown and the springing, the last links 22 of the module 20 form segments of the upper and lower chord 32A, 32B.

Given the span (S), the span-to-rise ratio, the loads, and the link length (l), the full geometry of the arch can then be determined for the three-hinged arch. See FIG. 5 for an example of the module 20 scribed onto the rational form for a span of 91.4 m (300 ft), a span-to-rise ratio of 5, and a link length l=3.05 m (10 ft).

Two-Hinged Arch

Scribing for the two-hinged arch is achieved using the same approach (FIGS. 11E-H). However, a structural depth is achieved at the crown by beginning mid-module, meaning that points 24A and 24B of the module 20 are at midspan. The horizontal coordinates of these points are: $A_{24x}$=0 and $B_{24x}$=0 and the vertical coordinates are that of the upper and lower curves 30A', 30B' at x=0, respectively. The coordinates of the point 24C are found by the intersection of circle 26A with a radius (l) centered at 24A with the equation:

$$\text{Circle } 26A\text{: } x^2+(y-A_{24y})^2 \quad \text{(Eq. 14)}$$

with circle 26B with a radius (l) centered at point 24B with the equation:

$$\text{Circle } 26B\text{: } x^2+(y-B_{24y})^2 \quad \text{(Eq. 15)}$$

Figure 11E:
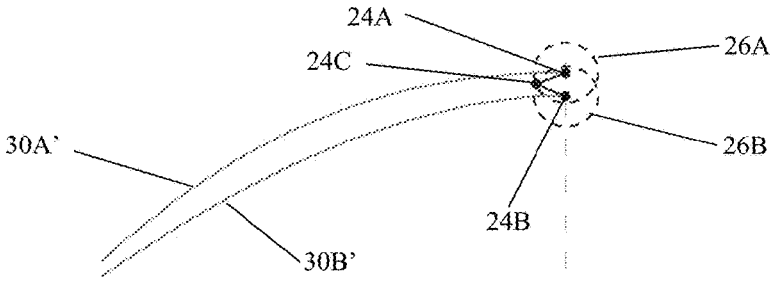
FIG. 11E is the first step in an example scribing procedure for a two-hinged arch.

(FIG. 11E). The coordinates of points 24A and 24B are then found by the intersection of upper and lower curves 30A', 30B' with circle 26C which has the following equation:

$$\text{Circle } 26C\text{: } (x-C_{24x})^2+(y-C_{24y})^2=l^2 \quad \text{(Eq. 16)}$$

Figure 11F:
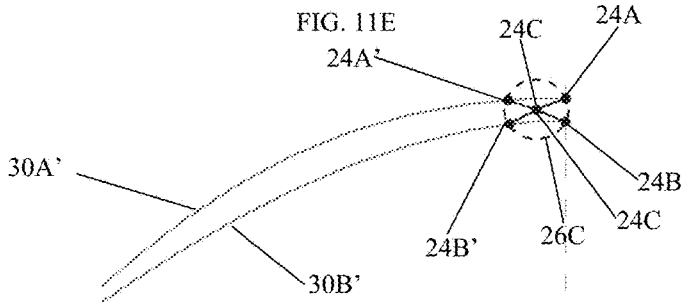
FIG. 11F is the second step in an example scribing procedure for a two-hinged arch.

(FIG. 11F). The coordinates of point 24C' are found by the intersection of circle 26E (centered at point 24A' with radius (l)):

$$\text{Circle } 26E\text{: } (x-A_{24x'})^2+(y-A_{24y'})^2=l^2 \quad \text{(Eq. 17)}$$

with circle 26D (centered at point 24B' with radius (l)):

$$\text{Circle } 26D\text{: } (x-B_{24x'})^2+(y-B_{24y'})^2=l^2 \quad \text{(Eq. 18)}$$

Figure 11G:
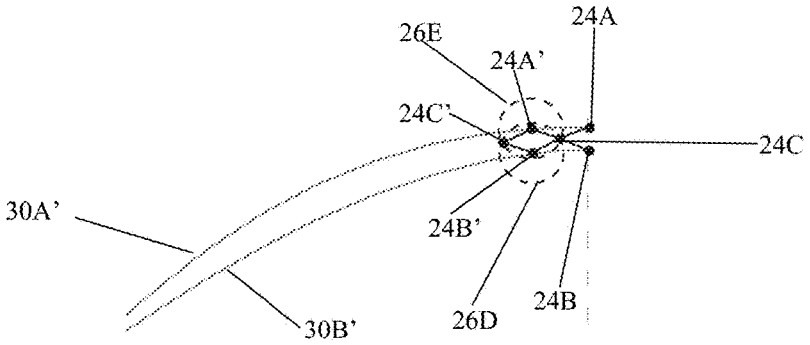
FIG. 11G is the third step in an example scribing procedure for a two-hinged arch.
Figure 11H:
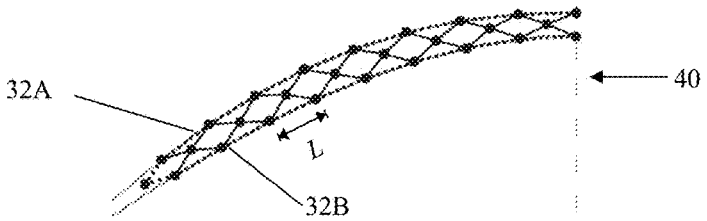
FIG. 11H is an example fully scribed two-hinged arch.

(FIG. 11G). This process continues until the termination criteria (i.e., a point 24C is within (2l) of the desired span) is met (FIG. 11H). As for the case of the three-hinged arch, the upper and lower chords 32A, 32B are formed by connecting the 24A points to one another by straight line segments and by connecting the 24B points (black dotted lines in FIG. 11H). At the springing, the last links 22 of the module 20 form segments of the upper and lower chord 32A, 32B. See FIG. 10 for an example of the module 20 scribed onto the rational form for a span of 91.4 m (300 ft), a span-to-rise ratio of 5, and a link length l=3.05 m (10 ft).

Parametric Investigation to Determine Optimized Link Length

Parametric studies were performed to determine an optimized link length (l) which is feasible for a wide variety of span lengths and for which the arch chord 32A, 32B segments have a low susceptibility to in-plane buckling. More specifically, the form development and scribing procedures discussed above were carried out for a range of link lengths (from 1.52 to 4.57 m (5 to 15 ft) in increments of 0.305 m (1 ft)) and spans (considering spans from 61.0 m to 183 m (200 to 600 ft) in increments of 15.2 m (50 ft), all with a span-to-rise ratio of 5). Some combinations are not feasible as the link lengths are too short to scribe the rational forms. Since arches are particularly susceptible to in-plane buckling (even more so than out-of-plane buckling as lateral bracing can be provided to prevent out-of-plane buckling modes), this parametric study investigated a metric related to this behavior. More specifically, the longest in-plane unbraced length of the upper or lower arch chord 32A, 32B (L in FIGS. 11D,H, connecting points 24A or points 24B and also shown in FIGS. 6A,C) was found through the scribing procedure for each link length and span combination. The metric used here considers this in-plane braced length squared ($L^2$) to relate to the critical Euler buckling load. The highest possible value for this metric is $(2l)^2$.

Figure 12:
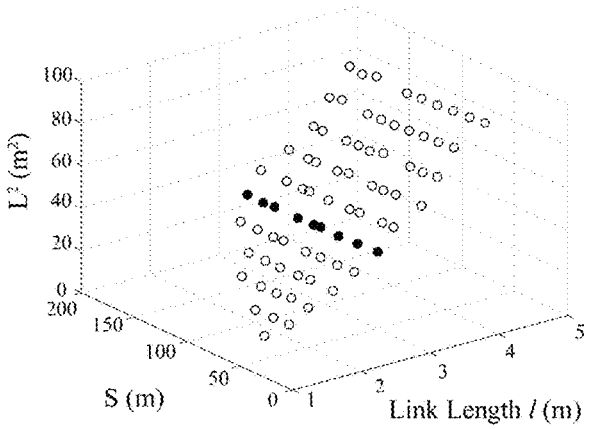
FIG. 12 is a three dimensional graph showing the results of parametric study to determine link length for the three-hinged arch. 3.05 m (10 ft) link length is highlighted in black.
Figure 13:
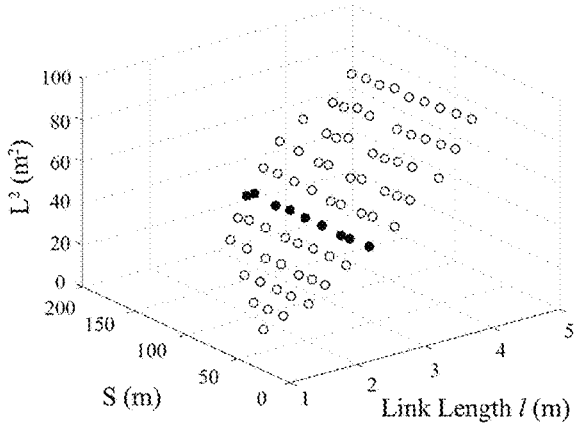
FIG. 13 is a three dimensional graph showing the results of parametric study to determine link length for the two-hinged arch. 3.05 m (10 ft) link length is highlighted in black.
Figure 14A:
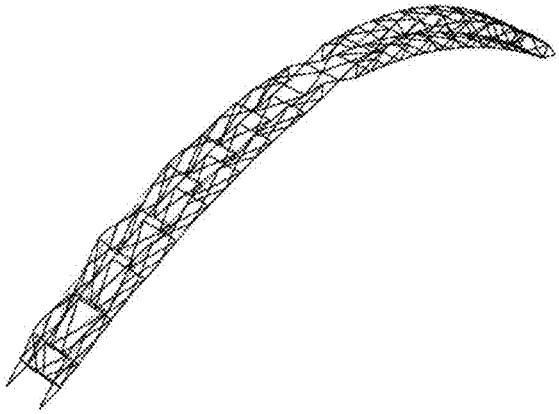
FIG. 14A is an isometric view showing the buckled shape for an example three-hinged arch forming a bridge. The shown buckling mode is under dead load, live load over left half span, and wind load (buckling factor=2.71).
Figure 14B:
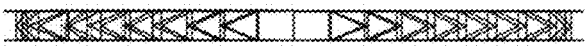
FIG. 14B is a top plan view of the buckled shape of the arch forming a bridge of FIG. 14A.
Figure 14C:
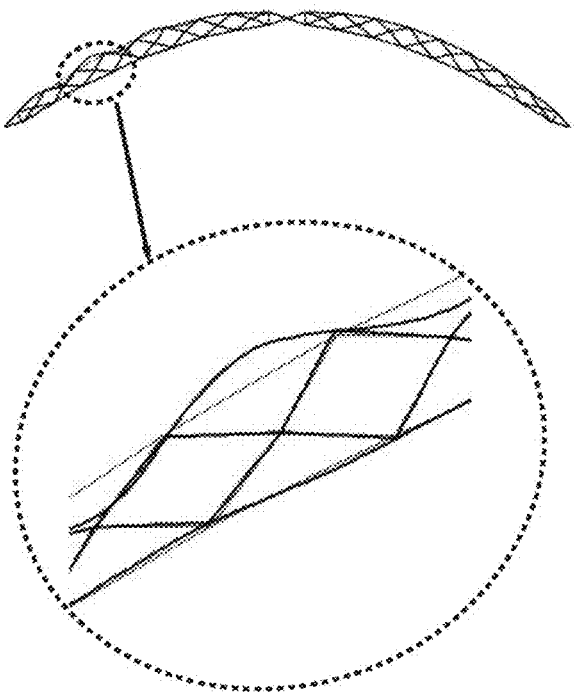
FIG. 14C is a detailed view of the buckled shape of the arch forming a bridge of FIG. 14A.
Figure 14D:
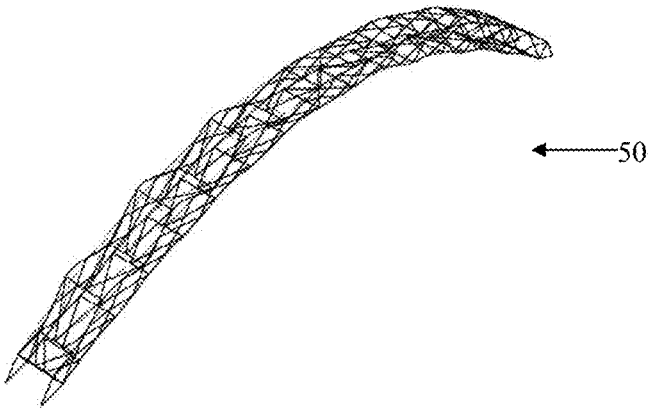
FIG. 14D is an isometric view of the buckled shape for an example two-hinged arch forming a bridge. The shown buckling mode is under dead load, live load over left half span, and wind load (buckling factor=3.09).
Figure 14E:
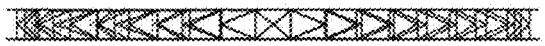
FIG. 14E is a top plan view of the buckled shape of the arch forming a bridge of FIG. 14D.
Figure 14F:
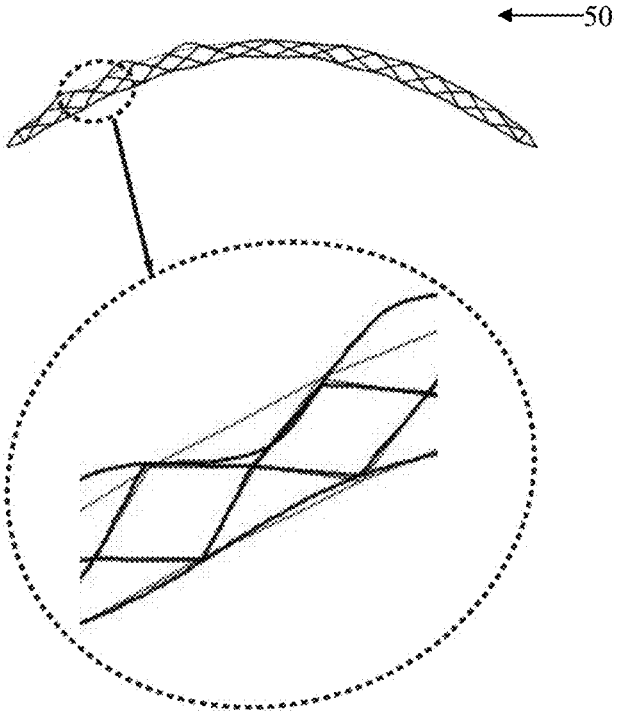
FIG. 14F is a detailed view of the buckled shape of the arch forming a bridge of FIG. 14D.

The results of the parametric study to determine the link length for the three- and two-hinged arches are shown in FIGS. 12 and 13, respectively. Note that the span lengths shown are not in even increments due to the module scribing termination criteria discussed earlier. The spans shown here are the horizontal distances from springing to springing (from a point 24C to a point 24C on opposite sides of the arch). From both FIGS. 12 and 13, it is clear that the smallest link length which is capable of achieving the full range of considered spans for three- and two-hinged arches is 3.05 m (10 ft), but other ranges of the link length have been considered and could be implemented by one of ordinary skill in the art as desired. As expected, this link length also relates to the lowest value of $L^2$.

A link length of 3.05 m (10 ft) is also supported by precedents in panelized bridging systems. The Bailey, Acrow, Mabey-Johnson panelized systems all use modules that are 3.05 m (10 ft) long, indicating that this is a reasonable size for handling rapidly erectable bridge components. Transportation advantages of this link length include that the module 20 can be transported flat with a total length of 6.10 m (20 ft). This makes the module 20 transportable in 6.10 m (20 ft) or 12.2 m (40 ft) ISO containers. Note that this length is approximate since, in reality, the module 20 is not able to collapse entirely on itself. Furthermore, there is an advantage in using the least number of modules 20 to achieve desired spans as this reduces the number of connections required. This reduces the field erection time and also the cost of the construction. By choosing the longest link length which is easily transportable, additional savings could be realized.

Based on the parametric study related to form, precedents in panelized bridging systems indicating handleability, and transportability considerations, a link length of 3.05 m (10 ft) was selected for further study (FIG. 2).

Demonstration of the Promise of the Adjustable Module

To demonstrate the promise of the module 20 for variable depth three- and two-hinged arches, three-dimensional finite element models of the forms—with a span of 91.4 m (300 ft), a span-to-rise ratio of 5, and a link length l=3.05 m (10 ft)—were built and analyzed under combined dead, live, and wind loads (FIGS. 6A-D). The dead load includes the self-weight of the arch members as well as a superimposed dead load for the deck (13.1 kN/m (900 lb/ft)). As considered earlier, the live load is the distributed lane load prescribed by AASHTO (9.34 kN/m (640 lb/ft)), which is considered to act over (1) the full span, (2) half the span, (3) ⅝ of the span, and (4) ⅜ of the center of the span (i.e., loads to generate worst effect on the arch). Projected gravity loads are applied to the upper chords 32A (half of this load on each plane). An assumed 2.39 kPa (50 psf) wind load is applied laterally to one bridge plane 40 of the arch. Linear (eigenvalue) buckling analyses of the forms were performed under these load combinations to understand global behavior of the system. More specifically, the software package SAP 2000 (v.17.3.0) was used to solve the following problem:

$$[K-\lambda g(p)]\Psi=0 \quad \text{(Eq. 19)}$$

where (K) is the stiffness matrix, (λ) is the eigenvalue matrix, (g) is the geometric stiffness for loads (p), and (Ψ) is the eigenvector matrix. Section sizes and a lateral bracing scheme were designed to achieve buckling factors (meaning the factor by which the load would need to be multiplied by to cause buckling) that exceed 2.5 for all load combinations. Only service loads were considered (i.e., load factors of 1) for this preliminary analysis.

Two planes of each arch were modeled representing the right and left bridge planes 40. These are spaced 4.57 m (15 ft) apart, to facilitate a 3.66 m (12 ft) design lane load as per AASHTO. The springing or restraint 42 of each arch plane is restrained to prevent translation in all directions and permit rotation only about the axis perpendicular to the plane of the arch. Arch chords 32A, 32B comprise straight line segments. Connections between these straight line segments are moment-resisting, with the exception of the chords 32A, 32B at the crown of the three-hinged arch and at the springing or restraint 42 for both arches where in-plane rotation is permitted to achieve hinges. The chords 32A, 32B are wide flange W10X39 steel sections in this example, oriented so that the strong axis is in the plane of the arch to resist out-of-plane buckling. The module members, L5X5X5/16 steel angle sections in this example, are pin-connected to one another and to the arch in the plane of the arch. This is to simulate the revolute joint 24 required for the modules 20 to be adjustable. Symmetric angle sections were chosen to resist in- and out-of-plane buckling. Chevron-type steel lateral bracing connects the planes. The same section sizes are used for the braces as for the chord to minimize the number of different types of sections in a rapidly erectable environment. These braces intersect the arch chord at each segment midpoint to avoid connecting to the chord at the same location as the module 20. All brace connections are moment-resisting. These section sizes were selected using an iterative approach in which the smallest section sizes (i.e., lowest weight) were chosen to achieve the desired buckling factors. A premium was placed on reducing the self-weight of the module 20 to ensure handleability and transportability. The same American Institute of Steel Construction (AISC) *Steel Construction Manual* standard rolled section sizes were chosen for the three- and two-hinged arch schemes to culminate in a unified kit-of-parts system which could be used for either form based on the site constraints and desired performance. However one of ordinary skill in the art would appreciate that the chord, bracing, and link elements could be made in many shapes and of a variety of materials including steel, aluminum, reinforced concrete, prestressed concrete, or advanced composites (e.g., glass or fiber reinforced polymers). Alternative bracing strategies (e.g., alternative configurations of members, cables) could also be implemented.

FIGS. 14A-F shows the buckled shape of these three- and two-hinged arches forming bridges 50 for the most critical loading in isometric, plan, and elevation views. The buckling mode for each system is local in-plane buckling of the chord 32A, 32B under dead, asymmetric live, and wind loads. In plan view (FIGS. 11B and 11D), negligible out-of-plane buckling is observed.

To best understand at least some of the advantages of the approach to modular construction disclosed herein, the variable depth three- and two-hinged adjustable module arch forms as a bridge 50 must be compared to an existing panelized bridging system in a girder-type configuration. The Bailey Bridge, in a triple-triple configuration to achieve the longest spanning simply supported bridge (64.0 m (210 ft)) allowable, is chosen as a representative existing system for comparison.

These systems are compared using a material efficiency metric, which is defined to be the span length squared divided by the self-weight because the moment of a simply supported beam under a uniform load is proportional to the span squared. This metric was chosen as a means of comparing different span systems and has been used in prior work related to panelized bridging systems. Note that the self-weight does not include the deck. The Bailey Bridge weight is based only on the weight of the panels and does not include the weight of the lateral bracing for simplicity. The weight of the module 20 is also compared as this relates to the handleability and transportability of the system. For reference, a single Bailey panel weighs 2.57 kN (577 lb) and can be carried by just 6 soldiers when using carrying bars. Table 1 provides the data related to the self-weight and material efficiencies of the different forms considered.

TABLE 1

Material efficiency for variable depth three- and two-hinged arch bridges, and an existing panelized systems (i.e., Bailey Bridge).

| Bridge Form | Mod. wt. (kN) | No. of mod. | Wt. (kN) | Mat. eff. ($m^2$/kN) |
|---|---|---|---|---|
| Var. depth three-hinged | 1.83 | 36 | 592 | 13.7 |
| Var. depth two-hinged | 1.83 | 34 | 590 | 12.2 |
| Bailey Bridge system | 2.57 | 378 | 970 | 4.22 |

Abbreviations:
Var. = variable,
mod. = module,
wt. = weight,
no. = number,
mat. = material,
eff. = efficiency.

The adjustable module 20 is 1.4 times lighter than the Bailey panel. This indicates the adjustable module's 20 handleability and transportability as it is be capable of being carried by less than 6 soldiers. Further weight reductions may also be possible if the adjustable module 20 were to be comprised of aluminum or advanced composites.

The material efficiency of both the three- and two-hinged arch bridges far exceeds that of the Bailey Bridge (by roughly a factor of 3). Further weight reductions (and therefore increases in material efficiency) for the three- and two-hinged arches may also be possible if the section sizes of the lateral bracing is reduced. These were chosen to be the same as the chord to result in a unified kit-of-parts system with the fewest number of different section sizes. Ultimately, this comparison shows the advantages of variable depth arches comprised of adjustable modules 20.

These preliminary studies have shown the promise of this new strategy for modular construction for the specific cases of variable depth three- and two-hinged arches. The adjustable module 20 could be used to form other bridge types where variable depths can provide material efficiency advantages, such as continuous trusses. It could also be used to develop constant depth curved geometries which are typically difficult to construct.

The present disclosure describes the efficacy of the adjustable module 20 for modular bridging. This strategy improves upon the material inefficiencies of existing panelized bridge systems comprised of rigid modules in a girder-type configuration by (1) forming arches which more efficiently use the available cross-section in compression as opposed to flexural behavior, and (2) facilitating a variable depth form based on demand to reduce system weight. This enhanced material efficiency is desirable for rapidly erectable, temporary systems where transportability and handleability are at a premium. These systems could be realized for military operations, to restore vital lifelines following natural or anthropogenic hazards, or as an accelerated construction approach for civil infrastructure.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents.

We claim:

1. A structural plane for forming a variable depth structure having a first end and a second end comprising:

a plurality of adjustable modules, each module comprising:

a first link with a first end and a second end;

a second link with a first end and a second end operably connected to the first end of the first link with an upper revolute joint;

a third link with a first end and a second end operably connected to the first end of the second link with a first lateral revolute joint;

a fourth link with a first end and a second end operably connected to the first end of the third link with a lower revolute joint and operably connected to the first link at a second lateral revolute joint;

an upper chord connecting the upper revolute joint of one of the plurality of adjustable modules to the upper revolute of an adjacent one of the plurality of adjustable modules;

a lower chord connecting the lower revolute joint of the one of the plurality of adjustable modules to the lower revolute of the adjacent one of the plurality of adjustable modules;

wherein the second lateral revolute joint of the one of the plurality of adjustable modules is operably connected to the first lateral revolute joint of the adjacent one of the plurality of adjustable modules;

wherein the first and second ends of the structural plane are restrained;

wherein the first lateral revolute joint of one of the plurality of adjustable modules nearest a first end of the structural plane is a first ultimate lateral revolute joint;

wherein the second lateral revolute joint of one of the plurality of adjustable modules nearest a second end of the structural plane is a second ultimate revolute joint; and wherein the first end is operably connected to the first ultimate lateral revolute joint, and the second end is operably connected to the second ultimate lateral revolute joint.

2. The structural plane of claim 1, wherein the adjustable modules, the upper chord, the and lower chord are constructed of steel.

3. The structural plane of claim 1, wherein each link is the same length.

4. The structural plane of claim 3, wherein the link length is 10 feet.

5. The structural plane of claim 1 wherein the adjustable modules are arranged such that the first lateral revolute joint of one of the adjustable modules is positioned at the midpoint of the structural plane.

6. The structural plane of claim 1, wherein the structural plane is formed as a three-hinged arch.

7. The structural plane of claim 1, wherein the adjustable modules are arranged such that the upper revolute joint and lower revolute joint of one of the adjustable modules are both positioned at the midpoint of the structural plane.

8. The structural plane of claim 1, wherein the structural plane is formed as a two-hinged arch.

9. The structural plane of claim 1, wherein the structural plane is formed as a fixed arch.

10. The structural plane of claim 1, wherein the links are angle sections.

11. The structural plane of claim 1, wherein the chord segments are wide flange sections.

12. The structural plane of claim 1, wherein two of the upper chords that are connected to the same upper revolute joint are connected to each other by a moment-resisting connection.

13. The structural plane of claim 1, wherein two of the lower cords that are connected to the same lower revolute joint are connected to each other by a moment-resisting connection.

14. The structural plane of claim 1, wherein the variable depth structure is one of following: a bridge, roof structure, building frame component, or a grid shell.

* * * * *